US006646611B2

(12) United States Patent
Plet et al.

(10) Patent No.: US 6,646,611 B2
(45) Date of Patent: Nov. 11, 2003

(54) MULTIBAND TELECOMMUNICATION ANTENNA

(75) Inventors: Jérôme Plet, Louannec (FR); Franck Colombel, Port Blanc (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/087,836

(22) Filed: Mar. 5, 2002

(65) Prior Publication Data

US 2002/0140618 A1 Oct. 3, 2002

(30) Foreign Application Priority Data

Mar. 29, 2001 (FR) ..... 01 04256

(51) Int. Cl.[7] ..... H01Q 1/24

(52) U.S. Cl. ..... 343/702; 343/797; 343/815; 343/817

(58) Field of Search ..... 343/702, 795, 343/797, 815, 817, 818, 853, 872; H01Q 1/24

(56) References Cited

U.S. PATENT DOCUMENTS 5,111,214 A * 5/1992 Kumpfbeck et al. ..... 343/841
5,629,713 A * 5/1997 Mailandt et al. ..... 343/808
5,710,569 A * 1/1998 Oh et al. ..... 343/817
5,841,401 A 11/1998 Bodley et al.
5,952,983 A 9/1999 Dearnley et al.
6,025,812 A * 2/2000 Gabriel et al. ..... 343/797
6,028,563 A 2/2000 Higgins
6,037,912 A * 3/2000 DeMarre ..... 343/815
6,211,841 B1 4/2001 Smith et al.

FOREIGN PATENT DOCUMENTS

WO WO 99/62139 A1 12/1999

* cited by examiner

*Primary Examiner*—Tho Phan
(74) *Attorney, Agent, or Firm*—Sughrue Mion, PLLC

(57) ABSTRACT

A three-band antenna is disclosed, intended in particular for cellular telecommunications. The antenna includes radiating elements operating in three frequency bands. UMTS radiating elements are separated by an optimum distance of $0.95\times\lambda_m$, where $\lambda_m$ represents the average wavelength of the UMTS frequency band. The positioning of the GSM and DCS radiating elements relative to the UMTS radiating elements is fixed so that each radiating element is similarly surrounded by other radiating elements and by partition walls. The structure is periodic along a longitudinal axis. In each module of the structure, a GSM radiating element is placed at the center of a quadrangle, two adjacent vertices of which are each occupied by a DCS radiating element and the other two vertices of which are each occupied by a UMTS radiating element.

5 Claims, 2 Drawing Sheets

MULTIBAND TELECOMMUNICATION ANTENNA

CROSS-REFERENCE TO RELATED APPLICATIONS

This application is based on French Patent Application No. 01 04 256 filed Mar. 29, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to multiband telecommunication antennas, in particular for cellular telephone systems.

2. Description of the Prior Art

Cellular telephone systems use various frequency bands corresponding to various existing telecommunication systems. Several telecommunication systems are used simultaneously at present, for example the digital cellular system (DCS) (1 710–1 880 MHz), and the Global System for Mobile communications (GSM) (870–960 MHz). New telecommunication systems are currently being installed, such as the Universal Mobile Telephone Service (UMTS) (1 900–2 170 MHz).

Telecommunication network operators must therefore provide a network of antennas operating in the various frequency bands used. Some operators install complementary networks of antennas, each network operating in accordance with one telecommunication system. Thus operators use a network of GSM antennas and a network of DCS antennas while they are installing a network of UMTS antennas.

However, the multiplication of antenna networks leads to increasing costs for the operators—purchase of antennas, leasing of locations, installation—and damages the environment. For this reason other operators use antennas operating in accordance with more than one telecommunications system. This reduces the installation cost and damage to the environment.

Two types of antennas are then used:

- A first type of antenna, known as a "wideband" antenna, uses a sufficiently wide operating band to be able to send and receive calls in accordance with more than one telecommunication system. For example, an antenna using a frequency band from 870 MHz to 1 880 MHz is used as a combined GSM and DCS antenna.
- A second type of antenna, known as a "multiband" antenna, combines, in a single antenna chassis, respective radiating elements conforming to more than one telecommunication system. For example, there are GSM and DCS dual band antennas including respective radiating elements for the GSM and the DCS.

FIG. 1 shows a prior art GSM and DCS dual band antenna. The dual band antenna 10 includes radiating elements 12 operating in accordance with the GSM and radiating elements 14 operating in accordance with the DCS. In this kind of antenna the GSM radiating elements 12 are connected to two GSM connectors 16 and 18 transmitting waves with frequencies in the GSM band. Similarly, the DCS radiating elements 14 are connected to two DCS connectors 20 and 22 transmitting waves with frequencies in the DCS band. FIG. 1 does not show the connection between the connectors and the GSM or DCS radiating elements.

Two independent connectors transmitting waves in the same frequency band are used because of the nature of the radiating elements used. Each radiating element—the operation of which is described in U.S. Pat. No. 6,025,798, for example—is equivalent to two independent dipoles at 90° to each other. Accordingly, the radiating elements 12 and 14 receive and/or send telecommunication signals correctly regardless of the position of a sending or receiving antenna relative to the radiating elements.

The set of radiating elements for the same band of frequencies forms a transmission device. Accordingly, the GSM radiating elements 12 form a GSM transmission device and the DCS radiating elements 14 form a DCS transmission device. To optimize the operation of each of these devices, two criteria are taken into account in the design of this prior art antenna:

- In accordance with a first criterion, the radiating elements for the same band of frequencies are separated by a distance substantially equal to $0.95\times\lambda_m$, where $\lambda_m$ represents the average wavelength of the band of frequencies associated with those radiating elements. It is known that this disposition of the radiating elements is favorable to the operation of the device positioned in this way.
- In accordance with a second criterion, the radiating elements of the same device are placed in the same vicinity, i.e. they are similarly surrounded by other nearby radiating elements and by metal partition walls whose function is described below.

In the case of a DCS and GSM dual band antenna, one feature of the wavelengths used facilitates the production of an antenna meeting the above two criteria. The average wavelength $\lambda_{DCS}$ of the DCS band is approximately equal to half the average wavelength $\lambda_{GSM}$ of the GSM band. It is therefore possible to produce an antenna having a periodic structure with the pitch for the DCS radiating elements equal to twice the pitch for the GSM radiating elements. Because of this feature, any GSM radiating element 12 is equidistant from two GSM radiating elements 12 and equidistant from two DCS radiating elements 14. Similarly, any DCS radiating element 14 is equidistant from two DCS radiating elements 14.

The symmetry in the disposition of the radiating elements of the two devices considerably reduces the consequences of radio frequency interference because each radiating element of the same device is affected by similar interference. The performance of a device—for example its signal to noise ratio—is improved if the radiating elements of the device operate under similar conditions.

Coupling between radiating elements of the same device substantially reduces its performance. To reduce such coupling, the radiating elements are partitioned off by metal walls whose positions also determine various characteristics of the radiation of each device, for example the horizontal aperture. Thus walls 26 perpendicular to a longitudinal axis 27 of the antenna partition off the GSM radiating elements 12 within rectangular enclosures also defined by the longitudinal walls 27*a* and 27*b* of the chassis of the antenna. The walls 26 reduce the coupling between the GSM radiating elements 12, thereby increasing the gain of the GSM device.

The gain of the GSM device is a function of the distance between the lateral walls 27*a* and 27*b* and the GSM radiating elements 12 and of the height of the walls 27*a* and 27*b*. If the GSM radiating elements 12 are substantially equidistant from the partition walls 27*a*, 27*b* and 26, an optimum configuration is obtained enabling the GSM device to operate in accordance with transmission criteria imposed by operators. Furthermore, the operation of the GSM device is optimized in terms of the second criterion previously referred to, because all the radiating elements of the device are similarly partitioned off.

Furthermore, the walls 26 are also used conjointly with fixed walls 24 along the axis 27 of the antenna to partition off the DCS radiating elements 14. This partitioning determines operating characteristics of the DCS device, such as its horizontal aperture or its gain. Nevertheless, the GSM radiating elements 12 are also placed along the axis 27 of the antenna. Metal walls close to a radiating element disturb its operation. For this reason the longitudinal walls 24 have a chamfer 25 near the GSM radiating elements 12.

The DCS radiating elements 14 are partitioned off in pairs of radiating elements in rectangular enclosures formed by the walls 24, 26 and 27*b*. To limit coupling between the DCS radiating elements 14 of each pair, a wall 28 is placed perpendicularly to the axis 27 between the radiating elements 14 of the pairs. Each wall 28 is equidistant from the two DCS radiating elements 14 separated in this way. Accordingly, these walls 28 are in the vicinity of a GSM radiating element 12 equidistant from the said two DCS radiating elements. The walls 28 therefore interfere with the GSM radiating elements 12 in the same way as the walls 24, because of the proximity of a partition wall to the GSM radiating elements 12. For this reason the walls 28 have a length which is less than the width of the enclosures partitioning off the DCS radiating elements 14. Moreover, the height of the walls 28 decreases as they approach the GSM radiating elements 12.

This decreasing profile represents a compromise between partitioning off the DCS radiating elements 14 and the disturbance of the GSM radiating elements 12 caused by these walls. Reducing the height of the wall 28 in the vicinity of the GSM radiating elements 12 reduces interference between the wall and the GSM radiating elements 12. The DCS radiating elements 14 are then substantially equidistant from the walls 24, 26, 27*b* and 28. As with the GSM radiating elements 12, this disposition is a result of optimizing the performance of the DCS device. Moreover, the partitioning being similar for all the DCS radiating elements 14, the interference suffered by all DCS radiating elements 14 is similar, thereby optimizing the operation of the DCS device.

Producing a dual band antenna made up of radiating elements specific to each transmission system therefore necessitates many compromises and artifices to enable correct operation of each device. Moreover, because the average wavelength $\lambda_{DCS}$ of the DCS band is approximately equal to half the average wavelength $\lambda_{GSM}$ of the GSM band, it is possible to situate the set of DCS and GSM radiating elements periodically along the axis of the antenna with an optimum distance between them.

The object of the invention is to propose a triple band antenna, for example a GSM/DCS/UMTS antenna, which operates satisfactorily even though the average wavelength of at least one band is not a multiple or sub-multiple of the average wavelengths of the other two bands.

SUMMARY OF THE INVENTION

The invention provides a radio antenna, in particular for use in cellular telecommunications, including first, second and third radiating elements adapted to operate in three respective different frequency bands, wherein the structure of the antenna is periodic along a longitudinal axis and, in each module of the structure, a first radiating element is placed at the center of a quadrilateral, two adjoining vertices of which are each occupied by one of the second radiating elements and the other two vertices of which are each occupied by one of the third radiating elements. Accordingly, the operation of each type of radiating element is optimized because each element of the same type is surrounded by a similar immediate vicinity, even though the average wavelength of at least one of the bands is not a multiple or sub-multiple of the average wavelength of the other two bands.

In a preferred embodiment, respective radiating elements are aligned in three rows parallel to the longitudinal axis of the antenna and corresponding to respective bands.

In a preferred embodiment, two adjoining radiating elements adapted to operate in the same frequency band are separated by a distance of $0.95\times\lambda_m$, where $\lambda_m$ represents the average wavelength of the frequency band.

In a preferred embodiment, in each module, the second radiating elements and the third radiating elements are placed in respective partitioned enclosures.

One particular embodiment of the antenna includes respective radiating elements adapted to operate in the DCS frequency band from 1 710 to 1 880 MHz, the GSM frequency band from 870 to 960 MHz and the UMTS frequency band from 1 900 to 2 170 MHz.

In a preferred embodiment, each module includes a GSM radiating element, a pair of UMTS radiating elements, and a pair of DCS radiating elements, and the two pairs of radiating elements define an approximate rectangle at the center of which the GSM radiating element is placed.

A triple band antenna of the above kind reduces installation, leasing and/or maintenance costs for the operator of a network wishing to introduce radiating elements for a new communication system—for example the UMTS—into its network at the same time as continuing to use systems already in use.

Moreover, the above kind of antenna has the advantage over a wideband antenna of using independent radiating elements for each telecommunication system. An operator equipped with the above type of antenna can therefore vary the coverage area of one of the telecommunication systems without modifying the coverage areas of the other systems using the antenna. The transmission coverage area of a device is varied by varying the signals feeding the device. It must be pointed out that a wideband antenna cannot effect this kind of modification, the device operating for each of the communication systems being the same.

Other features and advantages of the invention will become apparent from the description of some embodiments thereof, which description is given by way of non-limiting example and with reference to the accompanying drawings.

DETAILED DESCRIPTION OF THE PREFERRED EMBODIMENT

The average wavelength of the UMTS band is not a multiple or sub-multiple of the average wavelength of the GSM and DCS bands. Thus it is not possible to satisfy simultaneously for the three bands the two criteria previously cited, optimizing the operation of the radiating device for one band, namely:

an optimized spacing ($0.95\times\lambda_m$) between each pair of radiating elements of the device, and an identical vicinity for any radiating element for the same band of frequencies.

Figure 1:
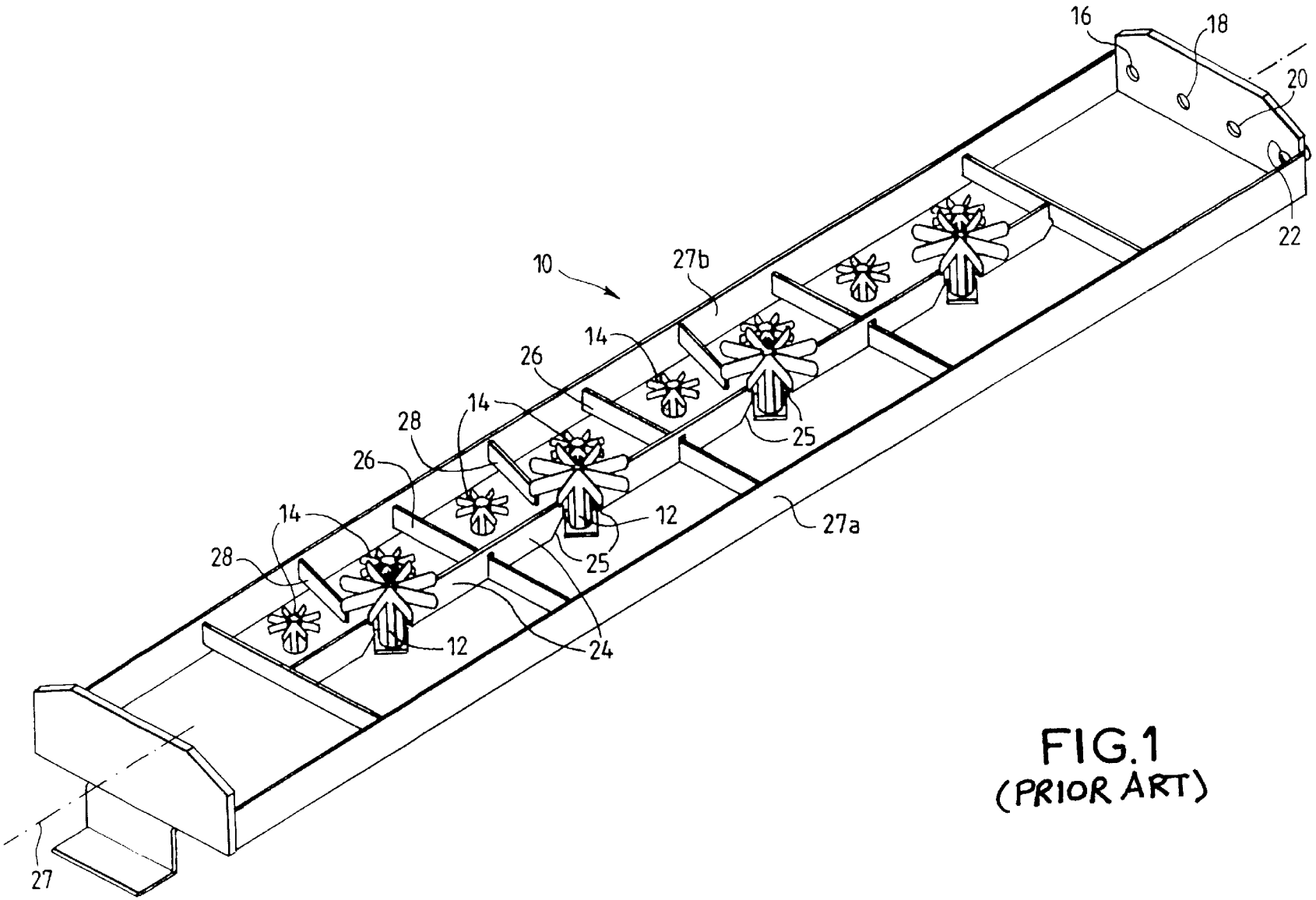
FIG. 1 (PRIOR ART)
FIG. 1 is a general view of a prior art dual band GSM/DCS antenna, already described.
Figure 2:
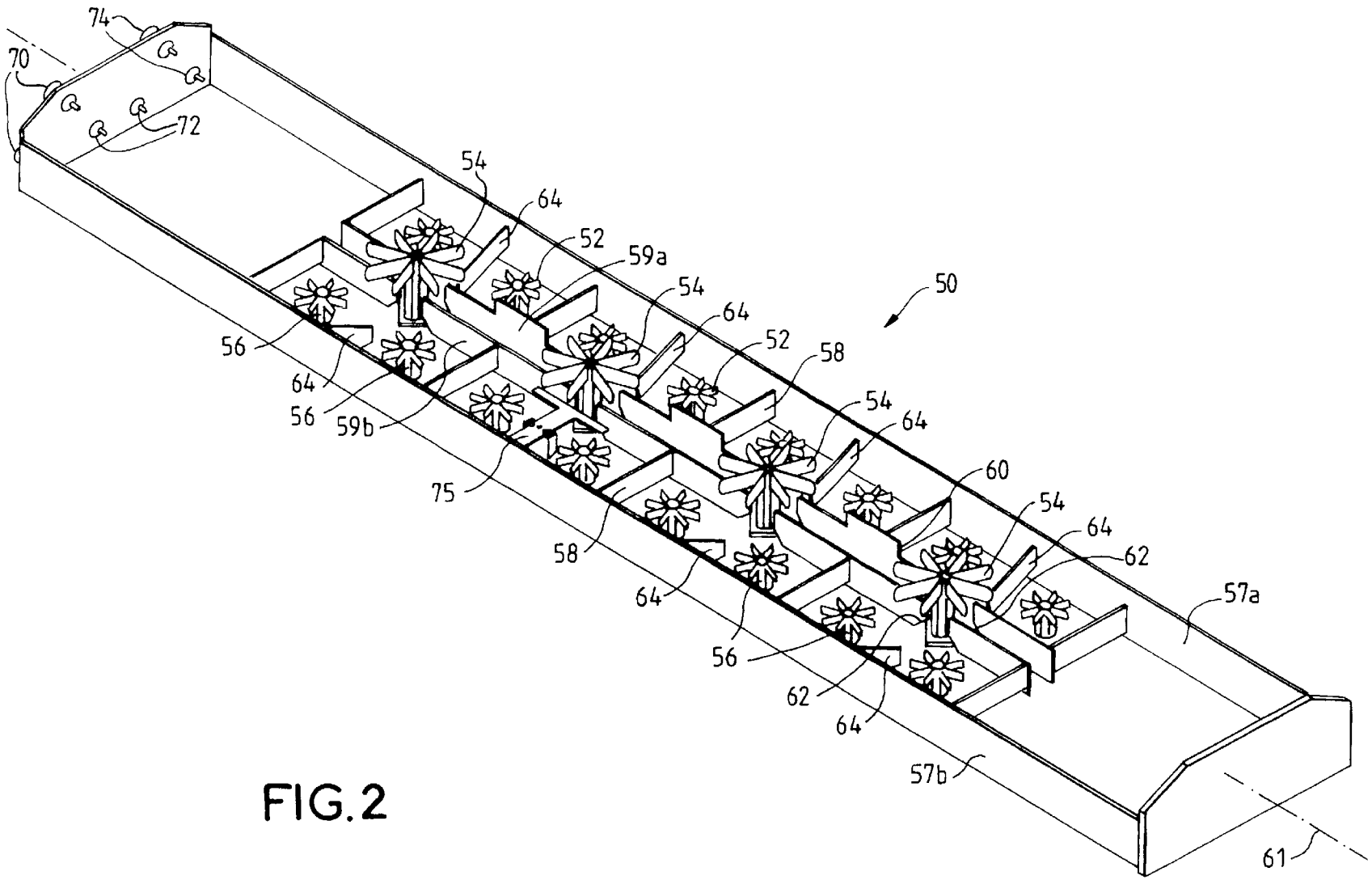
FIG. 2 is a general view of a triple band UMTS/GSM/DCS antenna conforming to the invention.

The antenna according to the invention is a compromise solution providing satisfactory operation. The embodiment shown in FIG. 2 includes radiating elements 52, 54 and 56 respectively adapted to operate in the UMTS, GSM and DCS bands: the radiating elements 52 operate in the UMTS frequency band 1 900–2 170 MHz, the radiating elements 54 operate in the GSM frequency band 870–960 MHz, and the radiating elements 56 operate in the DCS frequency band 1 710–1 880 MHz. The radiating elements 54 and 56 are identical to the radiating elements 12 and 14 previously described with reference to FIG. 1. The UMTS radiating elements 52 are similar to the GSM radiating elements 54 and the DCS radiating elements 56 but with technical features specific to the UMTS.

The antenna 50 has a periodic structure along its major axis 61, which is in the plane of symmetry of the antenna housing. The pitch is approximately equal to $0.85\times\lambda_{GSM}$, where $\lambda_{GSM}$ is the average wavelength in the GSM band. The periodic structure is made up of identical rectangular modules each comprising a GSM radiating element 54, a pair of UMTS radiating elements 52, and a pair of DCS radiating elements 56, placed so that the pairs of UMTS radiating elements 52 and DCS radiating elements 56 form a trapezium at the vertices of which they are located, a GSM radiating element 54 being situated at the center of this rectangle; the two UMTS radiating elements 52 occupy two adjoining vertices and the two DCS radiating elements 56 occupy the other two vertices. The radiating elements 54, 56, 52 of the whole of the antenna 50 are respectively aligned in three parallel rows parallel to the axis 61 of the antenna 50, the three rows respectively corresponding to the three bands.

In each module, the radiating elements are placed so that each GSM radiating element 54 is similarly surrounded by the UMTS radiating elements 52, the DCS radiating elements 56 and the partitions. Accordingly, each GSM radiating element 54 is equidistant from two GSM radiating elements 54, equidistant from two UMTS radiating elements 52, and equidistant from two DCS radiating elements 56.

The distance between two adjoining GSM elements 54, i.e. elements in two adjoining modules, is equal to the pitch, i.e. approximately equal to $0.85\times\lambda_{GSM}$. To give preference to the operation of the UMTS radiating elements 52, to obtain optimum performance for the UMTS device, the distance in a direction parallel to the axis 61 of the antenna between the UMTS radiating elements 52 (in the same module or in two adjoining modules) is $0.95\times\lambda_{UMTS}$, where $\lambda_{UMTS}$ is the average wavelength of the UMTS band. The distance between the DCS radiating elements 56 is $0.85\times\lambda_{DCS}$, where $\lambda_{DCS}$ is the average wavelength of the DCS band. Because the wavelengths $\lambda_{DCS}$ and $\lambda_{UMTS}$ are not very different, the UMTS radiating elements 52 and the DCS radiating elements 56 form a trapezium that is approximately a rectangle.

The UMTS device is therefore given preference over the DCS and GSM devices, whose radiating elements are not situated at an optimum distance from each other. The DCS radiating elements 56 are placed at a non-optimized distance equal to $0.85\times\lambda_{DCS}$. Similarly, the GSM radiating elements 54 are placed at a non-optimized distance approximately equal to $0.85\times\lambda_{GSM}$. Despite this, it is found that the GSM radiating elements 54 and the DCS radiating elements 56 operate correctly because, in accordance with the invention, each GSM radiating element 54 is surrounded by the same vicinity, which also comprises similar partitioning. Similarly, each DCS radiating element 56 is surrounded by the same vicinity, which also comprises similar partitioning.

To effect this partitioning, walls 58 are placed perpendicularly to a longitudinal axis 61 of the antenna. In each module of the antenna, to reduce the coupling between radiating elements, the walls 58 confine the UMTS radiating elements 52 in a first enclosure and the DCS radiating elements 56 in a second enclosure. Walls 59*a* and 59*b* complete the partitioning of the radiating elements of the antenna. The walls 59*a* and 59*b* are placed parallel to the vertical axis 61 on either side of the GSM radiating elements 54, which are placed along the longitudinal axis 61, which is in the plane of symmetry of the antenna housing.

Moreover, the walls 59*a* and 59*b* are discontinuous in the vicinity of the GSM elements 54, thereby increasing the distance between the walls 59*a* and 59*b* and the GSM radiating elements 54. Similarly, the walls 59*a* and 59*b* have cut-outs 62 near the GSM radiating elements 54 which further reduce interaction between the walls 59*a* and 59*b* and the GSM radiating elements 54. For the same reason, the wall 59*a* has cut-outs 60 in the vicinity of the GSM radiating elements 54.

The cut-outs are made in accordance with results obtained from experiments and are optional for the walls 59*a* and 59*b*.

The UMTS radiating elements 52 and the DCS radiating elements 56 are partitioned off in pairs. Oblique walls 64 are situated between the radiating elements of each pair, limiting coupling between the radiating elements of each pair. However, the height of these walls decreases in the vicinity of the GSM radiating elements 54, to reduce interference between the walls 58 and the DCS radiating elements 56.

The DCS radiating elements 56 are then approximately equidistant from the walls 58, 59*b*, 64 and a lateral wall 57*b* of the antenna. Conversely, the UMTS radiating elements 52 are intentionally offset within rectangular partitions formed by the walls 58, 59*a*, 64 and a lateral wall 57*a* of the antenna vis à vis the point equidistant from these walls. It is found experimentally that this offset, of the order of one centimeter, improves the performance of the UMTS device, in particular with regard to the pointing of the horizontal radiation diagram.

Independent double crossed polarization UMTS, GSM and DCS feeds 70, 72 and 74 are provided. This independence has the advantage that the sending and/or receiving areas of influence of each device can be varied. If an operator decides to modify the coverage area of the UMTS device of the antenna, the modification can be made without degrading the coverage areas of the DCS and GSM devices of the antenna. For example, the operator of a network can direct the UMTS beam of the antenna at an office area during the day and divert the beam toward a hotel area during the evening, keeping the DCS and GSM beams on the same coverage area. The beam is preferably diverted by modifying the feed to each device.

The present invention lends itself to variants that will be evident to the person skilled in the art. For example, some oblique walls 64 can be replaced by insulating elements 75 having a similar action.

What is claimed is:

1. A multiband radio antenna, for use in cellular telecommunications, including several first, several second and several third active radiating elements which operate in three respective different frequency bands, wherein said antenna has a structure which is periodic along a longitudinal axis;

wherein, in each module of a plurality of modules of said structure, a first radiating element is placed at a center of a quadrilateral, two adjoining vertices of which are each occupied by one of said second radiating elements, and the other two vertices of which are each occupied by one of said third radiating elements; and wherein respective radiating elements are aligned in three rows which are parallel to said longitudinal axis of said antenna, and which correspond to said three respective different frequency bands.

2. The antenna claimed in claim 1 wherein two adjoining radiating elements operate in the same frequency band and are separated by a distance of $0.95\times\lambda_m$, where $\lambda_m$ represents the average wavelength of said frequency band.

3. The antenna claimed in claim 1 wherein, in each module, said second radiating elements and said third radiating elements are placed in respective partitioned enclosures.

4. The antenna claimed in claim 1 including respective radiating elements adapted to operate in the DCS frequency band from 1 710 to 1 880 MHz, the GSM frequency band from 870 to 960 Mhz and the UMTS frequency band from 1 900 to 2 170 Mhz.

5. A multiband radio antenna, in particular for use in cellular telecommunications, including several first, several second and several third radiating elements which operate in three respective different frecquency bands, wherein said antenna has a structure which is periodic along a longitudinal axis, and wherein, in each module of a plurality of modules of said structure, a first radiating element is placed at a center of a quadrilateral, two adjoining vertices of which are each occupied by one of said second radiating elements and the other two vertices of which are each occupied by one of said third radiating elements;

wherein respective radiating elements are aligned in three rows which are parallel to said longitudinal axis of said antenna, and which correspond to said respective different frequency bands, said antenna including respective radiating elements which operate in the DCS frequency band from 1 710 to 1 880 MHz, the GSM frequency band from 870 to 960 MHz and the UMTS frequency band from 1 900 to 2 170 MHz; and wherein each module includes a GSM radiating element, a first pair of UMTS radiating elements, and a second pair of DCS radiating elements, and said first and second pairs of radiating elements define an approximate rectangle at a center of which said GSM radiating element is placed.

* * * * *